United States Patent [19]

Bailey et al.

[11] 4,131,777

[45] Dec. 26, 1978

[54] PUSHBUTTON ELECTRICAL SWITCHES AND PUSHBUTTONS THEREFOR

[75] Inventors: James R. Bailey, Chicago; Vernon W. Lavigne, Rolling Meadows, both of Ill.

[73] Assignee: Switchcraft, Inc., Chicago, Ill.

[21] Appl. No.: 769,894

[22] Filed: Feb. 18, 1977

[51] Int. Cl.[2] ..... H01H 9/00

[52] U.S. Cl. ..... 200/311; 200/314; 340/378 R; 40/490; 220/241

[58] Field of Search ..... 200/309, 311, 312, 314; 40/331, 332, 63 R, 142 R; 220/241, 242; 340/378 R, 378 A, 378 B

[56] References Cited

U.S. PATENT DOCUMENTS

| | | | |
|---|---|---|---|
| 1,879,554 | 9/1932 | Simkins | 40/63 R |
| 2,847,777 | 8/1958 | Page | 40/142 R |
| 3,268,889 | 8/1966 | Ast | 200/314 |
| 3,435,169 | 3/1969 | Bienwald et al. | 200/309 |
| 3,681,552 | 8/1972 | Bailey | 200/314 |
| 4,002,873 | 1/1977 | Lenandowski | 200/314 |

FOREIGN PATENT DOCUMENTS

| | | | |
|---|---|---|---|
| 160781 | 8/1921 | United Kingdom | 40/142 R |

*Primary Examiner*—William Price
*Assistant Examiner*—Joseph Man-Fu Moy
*Attorney, Agent, or Firm*—Richard L. Johnston

[57] ABSTRACT

Pushbuttons which are especially useful in illuminating pushbutton electrical switches are provided which have a hollow housing with an open face and sides extending inwardly from said face to an open rear end wherein said face constitutes a frame in which one or more separate resilient flat sheet-like display inserts or colored filters are mounted.

3 Claims, 7 Drawing Figures

PUSHBUTTON ELECTRICAL SWITCHES AND PUSHBUTTONS THEREFOR

BACKGROUND

Pushbutton electrical switches are well known and many different types of such switches have been made. Such switches, for example, often have pushbuttons which are formed from a molded plastic material, the outer face of which may be plain or may contain some indicia such as a numeral. In some cases, these pushbuttons are illuminated. Thus, in U.S. Pat. No. 3,681,552, a pushbutton electrical switch unit is described in which the pushbutton is illuminated from the interior of the switch by means of a lamp.

In switches of this type heretofore made, the pushbutton itself is normally made in such a way that if it bears any indicia on the face thereof and it is desired to substitute some other type of indicia, an entirely new pushbutton must be substituted.

It would be desirable to provide pushbutton electrical switch units with pushbuttons containing displays and/or color filters on the face thereof that can readily be inserted and removed.

OBJECTS

One of the objects of the present invention is to provide a new and improved illuminated pushbutton electrical switch and new and improved pushbuttons which are characterized by the fact that the outer face of the pushbutton constitutes a frame in which one or more separate display inserts or colored filters can be mounted from the front of the pushbutton.

Another object of the invention is to provide new and improved pushbuttons which are especially useful in pushbutton electrical switches and which contain display inserts and/or color filters which are readily replaceable.

Still another object of the invention is to provide new and improved pushbuttons which are especially useful in making illuminated pushbutton electrical switches.

Another object is to provide a new and improved process for applying displays and/or color filters to pushbuttons, especially pushbuttons for pushbuttons electrical switches.

Other objects and advantages will appear from the following description in conjunction with the accompanying drawings.

THE DRAWINGS

BRIEF SUMMARY OF THE INVENTION

In accordance with the invention, new and improved pushbuttons for electrical switches are provided and new and improved illuminated pushbutton electrical switches are provided wherein the pushbutton has a hollow housing with an open face and sides extending inwardly from said face to an open rear end, said face constituting a frame adapted to receive and retain one or more separate flat sheet-like inserts, and one or more separate resilient flat sheet-like display inserts mounted in said frame.

An important feature of the invention is that pushbuttons of this type can be used in a pushbutton electrical switch wherein a source of illumination is disposed forwardly of said switch and the pushbutton is disposed forwardly of said source of illumination.

A further feature of the invention is that separate transparent or translucent or other types of resilient flat sheet-like inserts can be mounted from the front of the frame of said pushbutton so that the display on the face of the pushbutton can be changed without substituting an entirely new pushbutton.

DETAILED DESCRIPTION OF THE INVENTION

Figure 1:
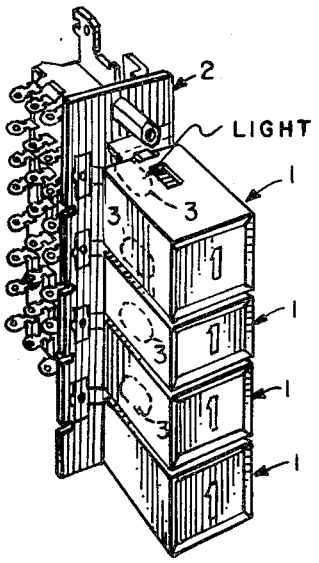
FIG. 1 is a perspective view of an assembly of pushbutton electrical switch units containing pushbuttons illustrating one embodiment of the present invention.

Referring to FIG. 1 the pushbutton switch assembly shown therein has pushbuttons 1 mounted on pushbutton switches, the operating parts of which are conventional and are not shown. The pushbutton switches are disposed in a panel 2 and each switch contains a lamp 3 which is disposed forwardly of the switch but behind the pushbutton 1.

Figure 5:
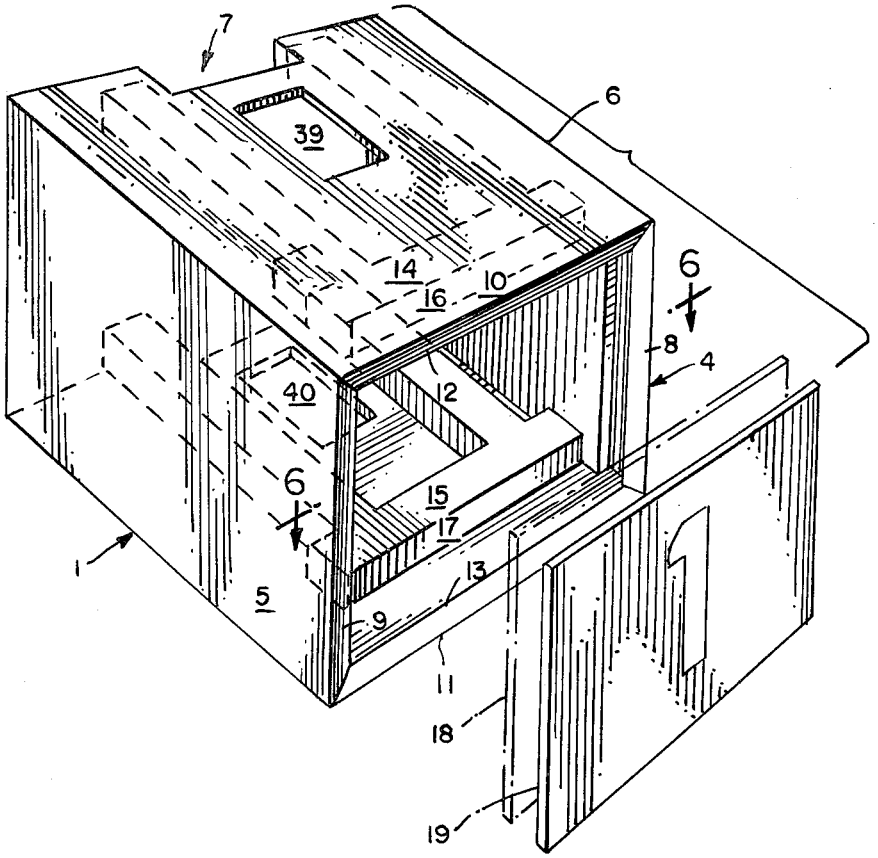
FIG. 5 is an exploded perspective view of the particular type of pushbutton shown in FIG. 1.

The pushbutton itself is shown enlarged in FIG. 5 and contains a rectangular frame 4 on the front face thereof. The pushbutton housing is hollow and has sides 5 and 6 extending inwardly from the front face to an open rear end 7. Two opposing sides of the housing have lips 8 and 9 which extend toward each other in the face of the housing. The other opposing sides 10 and 11 are substantially straight or turned inwardly only slightly in the areas 12 and 13 in the face of the housing. The housing also contains members 14 and 15, the outer surfaces of which 16 and 17 extend transversely in a central part of the sides 10 and 11 to form supporting surfaces for the inserts 18 and 19 which are mounted in the frame forming a front face of the pushbutton in the manner shown in FIGS. 6 and 7.

The insert 18 may be, for example, a color filter while the insert 19 is a display insert contaning a numeral or other type of display. Where the pushbutton is to be used in an illuminated pushbutton electrical switch, the inserts are transparent or translucent. The inserts must also be resilient flat sheet-like inserts which are capable of being bent so that they can be mounted in the frame portion of the pushbutton.

Figure 2:
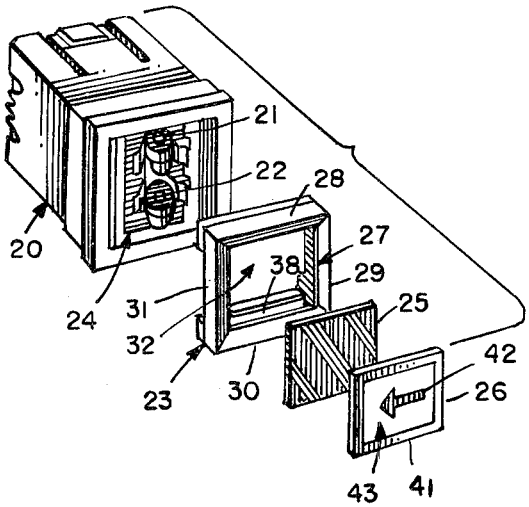
FIG. 2 is an exploded perspective view of another embodiment of the invention illustrating a pushbutton electrical switch with the components of the pushbutton separated from one another including a pushbutton housing, a colored filter insert and a display insert.

In the pushbutton 20 illustrated in FIG. 2, the pushbutton mechanism itself is similar to that shown in U.S. Pat. No. 3,681,552 and the pushbutton unit contans two electrical lamps 21 and 22 which provide illumination for the face of the pushbutton. The pushbutton 23 is adapted to be inserted into the opening 24 of the pushbutton electrical switch. A color filter 25 and a display unit 26 which are resilient flat sheet-like inserts that are transparent or translucent in predetermined areas are mounted in the frame portion 27 of pushbutton 23.

Figure 6:
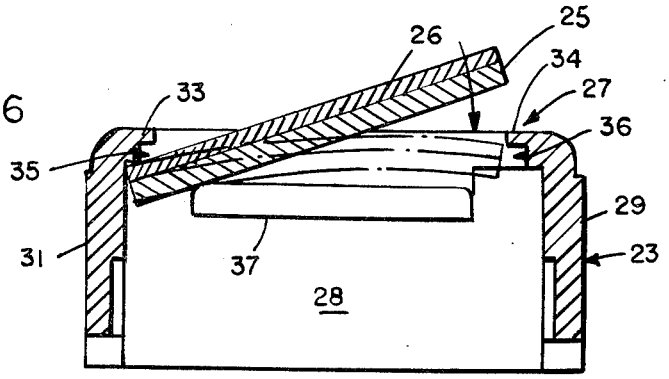
FIG. 6 is a sectional view of the particular type of pushbutton shown in FIG. 2 illustrating the method for applying one or more separate resilient flat sheet-like display inserts and color filters in the frame at the face of the pushbutton.
Figure 7:
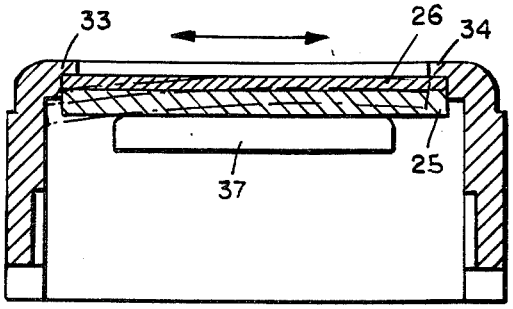
FIG. 7 is a cross section of the pushbutton shown in FIG. 2 with the inserts, one being a color filter and the other a display insert mounted therein.

The process of mounting the inserts within the frame of the pushbutton is illustrated in FIGS. 6 and 7. As shown in FIG. 2 the pushbutton frame 27 is rectangular and has four sides 28, 29 30 and 31. The central portion is hollow and has a front opening and a rear opening with a passageway 32 extending from front to rear.

Referring to FIGS. 6 and 7 it will be seen that the housing 23 of the pushbutton has opposing lips 33 and 34 with undercut portions 35 and 36. The sides 28 and 30 have inwardly extending supports 37 and 38 which oppose one another. The color filter 25 and the display member 26 which are transparent or translucent resilient flat sheet-like inserts are placed togehter as shown in FIG. 6 and inserted at an angle into the front end of the pushbutton housing so that they abut the undercut portion 35 and the lower side of insert 25 rests on opposing edges on inwardly extending supports 37 and 38. The flexible inserts are then pressed downwardly in the direction of the arrow and then moved together as a unit from left to right until they occupy the position shown in FIG. 7 wherein the insert 26 is seated beneath and in contact with lips 33 and 34 and insert 25 rests on and is supported by the inwardly extending supports 37 and 38, the support 37 being in the side 28 of the housing and the support 38 being in the opposite side 30 of the housing (see FIG. 2).

The pushbutton can be molded in any suitable manner from any suitable thermosetting or thermosplastic resin material of a type well known in the art and the various components of the housing are preferably molded in a single piece. The material from which the pushbutton housing is made is preferably slightly resilient so that the pushbutton can be mounted on the switch unit by pressing it into a cavity as shown in U.S. Pat. No. 3,681,552. It will be understood that the manner in which the pushbutton is mounted on the switch unit does not form a part of this invention. In the case of a pushbutton of the type shown in FIG. 5, mounting is effected by engagement between the openings 39 and 40 and outwardly extending elements of the switch actuating mechanism.

It will be recognized that many different combinations of color filters and display inserts can be employed in the practice of the invention. Thus in the inserts shown in FIG. 2 the display insert 26 can have a black opaque border 41 with a black opaque arrow 42 and a clear area 43. The filter 25 can be red, green, yellow, orange or any other color which will then be the color of the area 43 as seen by the viewer.

Figure 3:
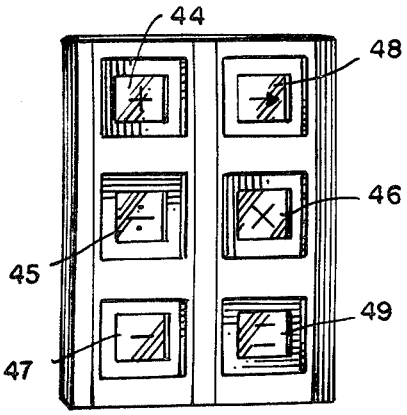
FIG. 3 is an elevational view showing the face of an assembly of pushbutton electrical switches with various types of displays for different switches.

Different types of display inserts are illustrated in FIG. 3 such as a display insert 44 containing a plus sign, a display insert 45 containing a division sign, a display insert 46 containing a multiplication sign, a display insert 47 containing a minus sign, a display insert 48 containing an arrow and a display insert 49 containing an equal sign.

Figure 4:
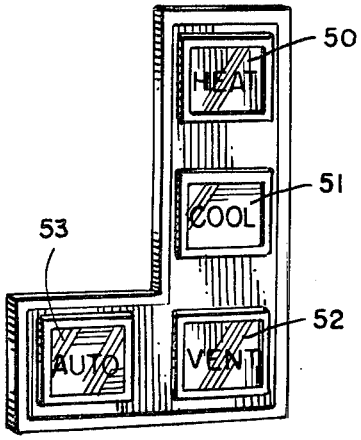
FIG. 4 is another elevational view showing the face of an assembly of pushbutton electrical switches with different types of displays applied to the faces of different pushbuttons.

In FIG. 4 the display inserts 50, 51, 52 and 53 contain words which indicate the function of the switches to which the pushbuttons are attached.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. An illuminated pushbutton electrical switch comprising:

(a) an electrical switch, (b) a source of illumination disposed forwardly of said switch of (a);

(c) a pushbutton which can be pushed to actuate said switch of (a) and which is disposed forwardly of said source of illumination of (b), said pushbutton comprising a hollow housing with an open front face and sides extending inwardly from said face to an open rear end, said face constituting a frame adapted to receive and retain one or more separate flat sheet-like inserts, and (d) one or more separate transparent or translucent, resilient flat sheet-like inserts mounted in said frame so as to be illuminated by said source of illumination of (b), said frame in said face of said pushbutton of (c) being rectangular, two opposing sides of said housing being undercut to form lips adjacent said face and the other two opposing sides of said housing containing inwardly extending supports for said inserts, said supports being opposite one another and spaced inwardly from said lips so as to retain said inserts between the inner sides of said lips and the upper sides of said supports, whereby said inserts can be inserted or changed through said front face by flexing them between said lips.

2. A switch as claimed in claim 1 wherein there are two inserts of (d), an outer insert and an inner insert, the outer insert being a display screen and the inner insert being a colored light filter.

3. A switch as claimed in claim 1 wherein said pushbutton of (c) is molded in one piece of a rigid plastic material and said inserts are made of a slightly flexible plastic material.

* * * * *